US009976784B2

(12) United States Patent
Hirayama et al.

(10) Patent No.: US 9,976,784 B2
(45) Date of Patent: May 22, 2018

(54) EVAPORATOR

(71) Applicant: KEIHIN THERMAL TECHNOLOGY CORPORATION, Oyama-shi (JP)

(72) Inventors: Takashi Hirayama, Oyama (JP); Motoyuki Takagi, Oyama (JP)

(73) Assignee: KEIHIN THERMAL TECHNOLOGY CORPORATION, Oyama-shi (JP)

( * ) Notice: Subject to any disclaimer, the term of this patent is extended or adjusted under 35 U.S.C. 154(b) by 577 days.

(21) Appl. No.: 13/948,092

(22) Filed: Jul. 22, 2013

(65) Prior Publication Data

US 2014/0020425 A1 Jan. 23, 2014

(30) Foreign Application Priority Data

Jul. 23, 2012 (JP) ..... 2012-162553

(51) Int. Cl.
*F25D 21/14* (2006.01)
*F25B 39/02* (2006.01)
(Continued)

(52) U.S. Cl.
CPC ..... *F25B 39/02* (2013.01); *F25B 39/022* (2013.01); *F28D 1/05341* (2013.01);
(Continued)

(58) Field of Classification Search
CPC ..... F25B 39/02; F25B 39/022; F28F 9/0224; F28F 17/005; F28F 9/0278;
(Continued)

(56) References Cited

U.S. PATENT DOCUMENTS 5,586,600 A * 12/1996 Cribari ..... F28F 9/0212 165/173
7,726,389 B2 * 6/2010 Watanabe ..... F25B 39/022 165/176
(Continued)

FOREIGN PATENT DOCUMENTS

JP 0735442 A * 2/1995
JP 2007-247891 9/2007
(Continued)

OTHER PUBLICATIONS

Japanese Office Action for corresponding JP Application No. 2012-162553, dated Mar. 22, 2016.

*Primary Examiner* — Frantz Jules
*Assistant Examiner* — Martha Tadesse
(74) *Attorney, Agent, or Firm* — Mori & Ward, LLP

(57) ABSTRACT

An evaporator has a first longitudinal direction and includes first and second header tanks. The first header tank includes a first surrounding wall projecting from at least one of a first end portion and a second end portion along a first longitudinal direction to define a first recess to surround the first recess at at least one of the first end portion and the second end portion. The first surrounding wall has at least one first drain opening to drain water from the first recess. The second header tank has a second longitudinal direction and is disposed apart from the first header tank so that the first longitudinal direction is substantially parallel to the second longitudinal direction. The second header tank has a second surrounding wall having at least one second drain opening to drain water from the second recess.

10 Claims, 6 Drawing Sheets

(51) Int. Cl.
*F28F 9/02* (2006.01)
*F28F 17/00* (2006.01)
*F28D 1/053* (2006.01)

(52) U.S. Cl.
CPC ..... *F28F 9/0204* (2013.01); *F28F 9/0224* (2013.01); *F28F 17/005* (2013.01)

(58) Field of Classification Search
CPC ..... F28D 2021/0085; F28D 2021/0084; F28D 1/05366; F01P 11/0276; F25D 21/14
See application file for complete search history.

(56) References Cited

U.S. PATENT DOCUMENTS 8,176,750 B2 * 5/2012 Higashiyama ..... F25B 39/028 62/515
2004/0016535 A1 * 1/2004 Shimanuki ..... F24F 13/222 165/172
2005/0172664 A1 * 8/2005 Cho ..... F28D 1/05391 62/515
2005/0211425 A1 * 9/2005 McKittrick ..... F28F 9/0212 165/174
2007/0205598 A1 * 9/2007 Katoh ..... F16L 13/122 285/30
2007/0251682 A1 * 11/2007 Sasaki ..... F28D 1/0391 165/153
2008/0296003 A1 * 12/2008 Higashiyama ..... F25B 39/028 165/153
2008/0314076 A1 * 12/2008 Ichiyanagi ..... F25B 9/008 62/513
2010/0083694 A1 * 4/2010 Takagi ..... F25B 39/022 62/515
2012/0204595 A1 * 8/2012 Tamaki ..... F28D 1/05391 62/498
2015/0027161 A1 * 1/2015 Ohtani ..... F25B 39/02 62/515

FOREIGN PATENT DOCUMENTS

JP 2010-112695 5/2010
JP 2010-197019 9/2010
JP 2011-085343 4/2011

* cited by examiner

EVAPORATOR

CROSS-REFERENCE TO RELATED APPLICATIONS

The present application claims priority under 35 U.S.C. § 119 to Japanese Patent Application No. 2012-162553, filed Jul. 23, 2012. The contents of this application are incorporated herein by reference in their entirety.

BACKGROUND OF THE INVENTION

Field of the Invention

The present invention relates to an evaporator.

Discussion of the Background

The present applicant has proposed an evaporator of a car air conditioner (see Japanese Patent Application Laid-Open (kokai) No. 2010-112695). The proposed evaporator includes a pair of header tanks which are disposed apart from each other in the vertical direction such that their longitudinal direction is perpendicular to the vertical direction and an air-passing direction; and a plurality of flat heat exchange tubes which are disposed between the upper and lower header tanks such that their longitudinal direction coincides with the vertical direction and whose width direction coincides with the air-passing direction. Each header tank has leeward and windward header sections whose longitudinal directions coincide with the longitudinal direction of the header tank and which are juxtaposed in the air-passing direction. A refrigerant inlet is provided at one end of the leeward header section of one header tank, and a refrigerant outlet is provided at one end of the windward header section of the header tank, which end is located on the same side as the one end of the leeward header section. A single tube row composed of a plurality of heat exchange tubes arranged in the longitudinal direction of the header tanks is disposed between the leeward header sections of the upper and lower header tanks, and another tube row composed of a plurality of heat exchange tubes arranged in the longitudinal direction of the header tanks is disposed between the windward header sections of the upper and lower header tanks. Upper and lower end portions of the heat exchange tubes are connected to the corresponding upper and lower header sections. The leeward and windward header sections of the one header tank which has the refrigerant inlet and the refrigerant outlet at one end thereof have recesses which are formed on the outer surfaces of ends of the leeward and windward header sections, the ends being located on the side opposite the one end of the one header tank. Similarly, the leeward and windward header sections of the other header tank have recesses which are formed on the outer surfaces of opposite ends of the leeward and windward header sections.

SUMMARY OF THE INVENTION

According to one aspect of the present invention, an evaporator includes a pair of header tanks and a plurality of heat exchange tubes. The pair of header tanks are disposed apart from each other in a vertical direction. The plurality of heat exchange tubes are disposed between the upper and lower header tanks such that their longitudinal direction coincides with the vertical direction and whose upper and lower end portions are connected to the upper and lower header tanks, respectively. Each of the header tanks has a recess formed on an outer surface of at least one of opposite longitudinal ends thereof. A drain opening for draining water from the recess is formed in a lower portion of a wall portion of the header tank which surrounds the recess.

According to another aspect of the present invention, an evaporator includes a first header tank, a second header tank, and a plurality of heat exchange tubes which are provided between the first header tank and the second header tank to connect the first header tank and the second header tank. The first header tank has a first longitudinal direction. The first header tank has a first end portion and a second end portion opposite to the first end portion along the first longitudinal direction. The first header tank includes a first surrounding wall projecting from at least one of the first end portion and the second end portion along the first longitudinal direction to define a first recess to surround the first recess at at least one of the first end portion and the second end portion. The first surrounding wall has at least one first drain opening to drain water from the first recess. A second header tank has a second longitudinal direction and is disposed apart from the first header tank so that the first longitudinal direction is substantially parallel to the second longitudinal direction. The second header tank has a third end portion and a fourth end portion opposite to the third end portion along the second longitudinal direction. The second header tank includes a second surrounding wall projecting from at least one of the third end portion and the fourth end portion along the second longitudinal direction to define a second recess to surround the second recess at at least one of the third end portion and the fourth end portion. The second surrounding wall has at least one second drain opening to drain water from the second recess.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENT

An embodiment of the present invention will next be described with reference to the drawings. In the embodiment to be described hereinafter, an evaporator according to an embodiment of the present invention is applied to an evaporator of a refrigeration cycle which constitutes a car air conditioner.

The term "aluminum" as used in the following description encompasses aluminum alloys in addition to pure aluminum.

Figure 2:
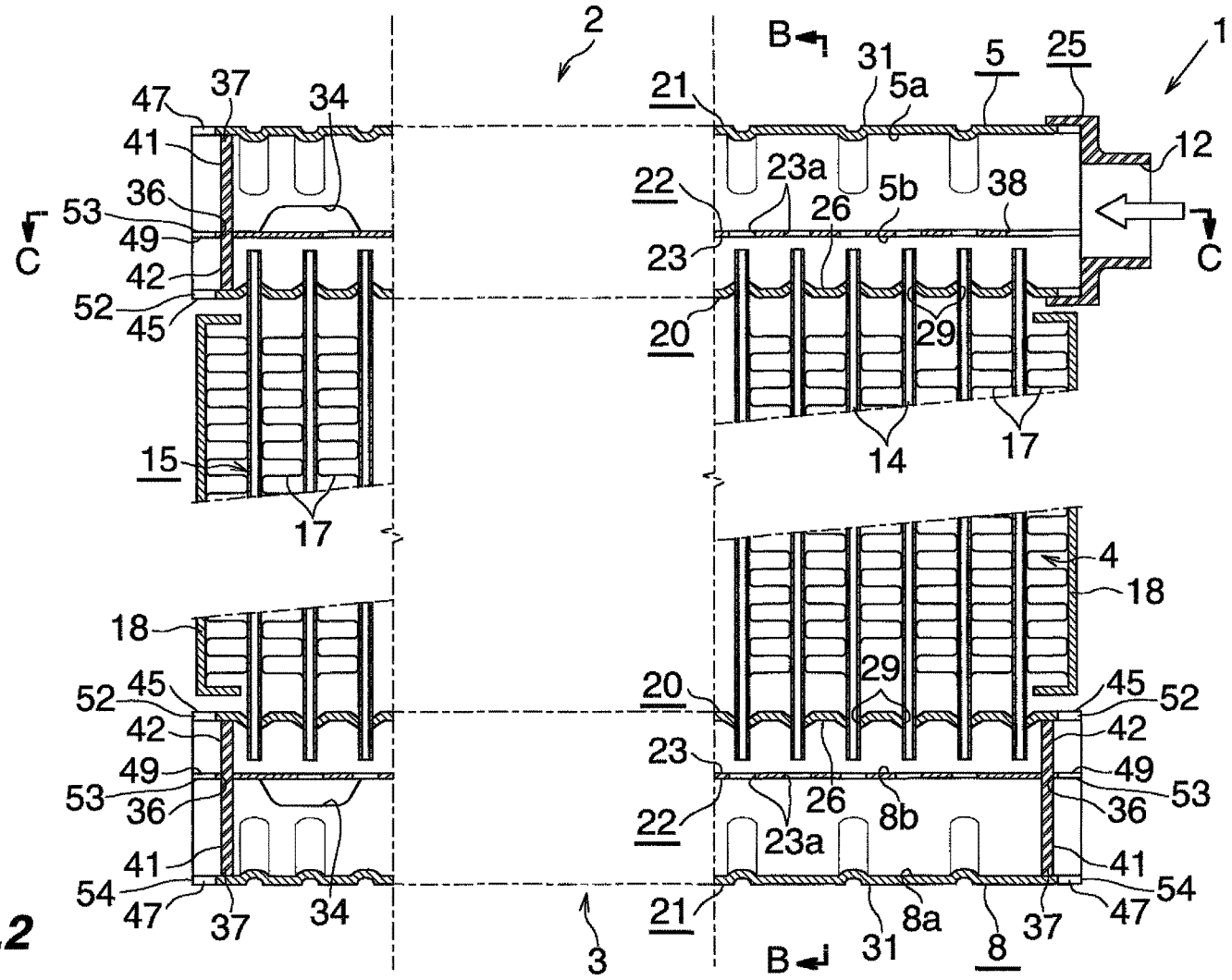
FIG. 2 is a partially omitted enlarged sectional view taken along line A-A of FIG. 1.
Figure 3:
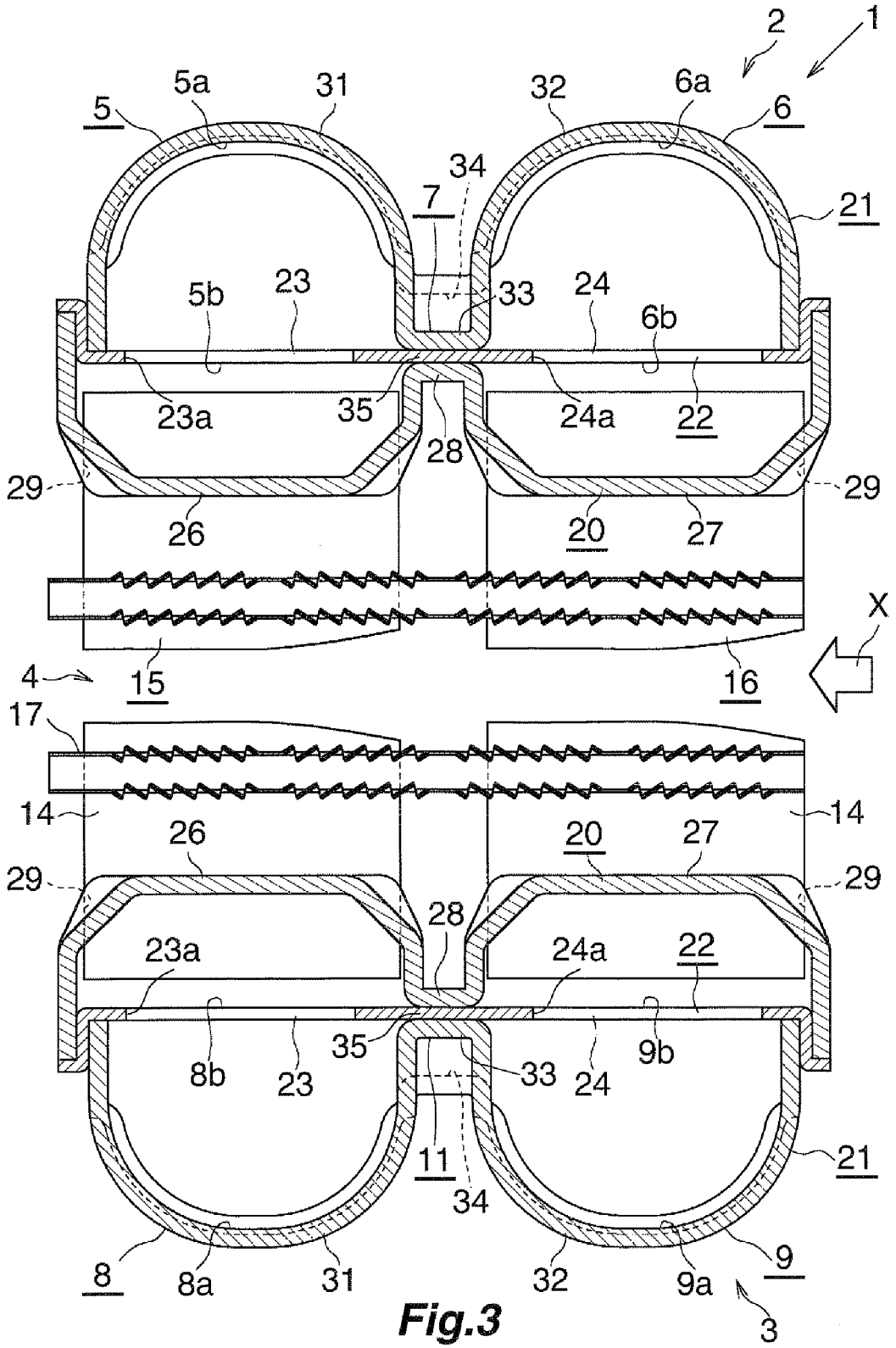
FIG. 3 is a partially omitted enlarged sectional view taken along line B-B of FIG. 2.
Figure 4:
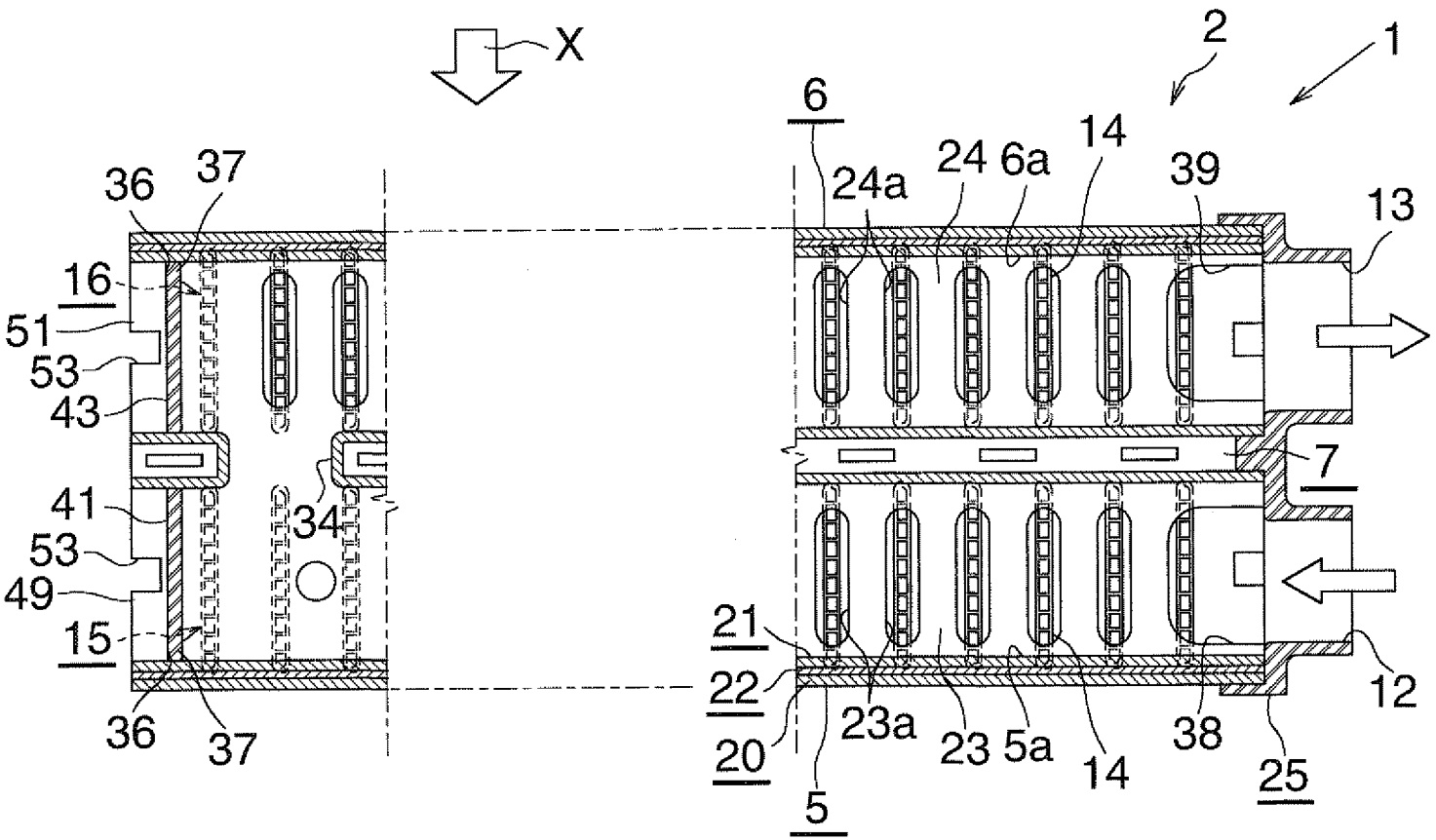
FIG. 4 is a partially omitted sectional view taken along line C-C of FIG. 2.

In the following embodiments, the downstream side with respect to an air-passing direction (a direction represented by arrow X in the drawings), which is the direction of air passing through air-passing clearances between adjacent heat exchange tubes, will be referred to as the "front," and the opposite side as the "rear." Also, the left-hand and right-hand sides as viewed rearward from the front side (the left-hand and right-hand sides of FIG. 2) will be referred to as "left" and "right," respectively.

Figure 1:
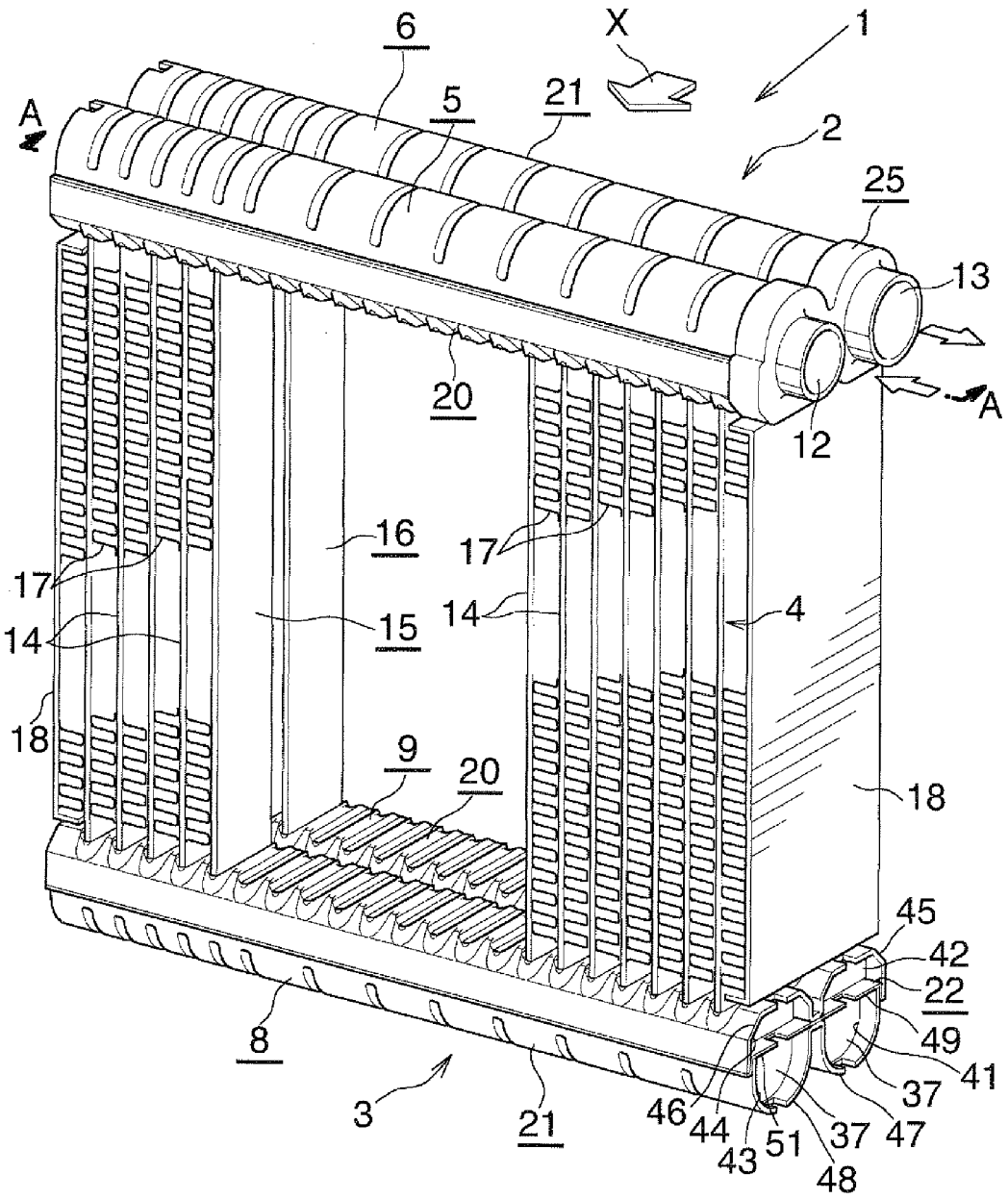
FIG. 1 is a partially cut-away perspective view showing the overall structure of an evaporator according to an embodiment of the present invention is applied.

FIG. 1 shows the overall structure of an evaporator to which the evaporator according to an embodiment of the present invention is applied, and FIGS. 2 to 5 show the structure of a main or essential portion of the evaporator of FIG. 1.

As shown in FIGS. 1 to 4, an evaporator 1 includes a first header tank (for example, an upper header tank) 2 and a second header tank (for example, a lower header tank) 3, which are formed of aluminum, and a heat exchange core section 4 provided between the two header tanks 2 and 3.

The upper header tank 2 has a first longitudinal direction. The upper header tank 2 has a first end portion and a second end portion opposite to the first end portion along the first longitudinal direction. The upper header tank 2 includes a first surrounding wall projecting from at least one of the first end portion and the second end portion along the first longitudinal direction to define a first recess to surround the first recess at at least one of the first end portion and the second end portion. The first surrounding wall has at least one first drain opening to drain water from the first recess.

The lower header tank 3 has a second longitudinal direction and disposed apart from the upper header tank 2 so that the first longitudinal direction is substantially parallel to the second longitudinal direction. The lower header tank 3 has a third end portion and a fourth end portion opposite to the third end portion along the second longitudinal direction. The lower header tank 3 includes a second surrounding wall projecting from at least one of the third end portion and the fourth end portion along the second longitudinal direction to define a second recess to surround the second recess at at least one of the third end portion and the fourth end portion. The second surrounding wall has at least one second drain opening to drain water from the second recess.

The upper header tank 2 and the lower header tank 3 are disposed apart from each other in the vertical direction such that their longitudinal direction coincides with a direction (left-right direction) perpendicular to two directions; i.e., the vertical direction and the air-passing direction.

The upper header tank 2 includes a leeward header section 5 disposed on the leeward side (front side) such that their longitudinal direction coincides with the left-right direction; a windward header section 6 disposed on the windward side (rear side) such that their longitudinal direction coincides with the left-right direction; and a connection portion 7 which connects and unites the two header sections 5 and 6 together. The lower header tank 3 includes a leeward header section 8 disposed on the leeward side (front side) such that their longitudinal direction coincides with the left-right direction; a windward header section 9 disposed on the windward side (rear side) such that their longitudinal direction coincides with the left-right direction; and a connection portion 11 which connects and unites the two header sections 8 and 9 together. In the following description, the leeward header section 5 of the upper header tank 2 will be referred as a leeward upper header section; the leeward header section 8 of the lower header tank 3 will be referred to as a leeward lower header section; the windward header section 6 of the upper header tank 2 will be referred to as a windward upper header section; and the windward header section 9 of the lower header tank 3 will be referred to as a windward lower header section. A refrigerant inlet 12 is provided at the right end of the leeward upper header section 5, and a refrigerant outlet 13 is provided at the right end of the windward upper header section 6.

In the heat exchange core section 4, two tube rows 15 and 16 are juxtaposed in the front-rear direction. Each of the tube rows 15 and 16 is composed of a plurality of flat heat exchange tubes 14 which are formed of aluminum extrudate and which are disposed such that they are spaced apart from one another in the left-right direction and such that their longitudinal direction coincides with the vertical direction and their width direction coincides with the air-passing direction. Corrugate fins 17 formed of aluminum are disposed in air-passing clearances between adjacent heat exchange tubes 14 of each of the tube rows 15 and 16 and on the outer sides of the heat exchange tubes 14 at the left and right ends such that the corrugate fins 17 extend across the heat exchange tubes 14 of the front and rear tube rows 15 and 16. The corrugate fins 17 are brazed to the corresponding heat exchange tubes 14. Side plates 18 formed of aluminum are disposed on the outer sides of the corrugate fins 17 at the left and right ends and are brazed to the corresponding corrugate fins 17. Upper and lower end portions of the heat exchange tubes 14 of the leeward tube row 15 are communicatably connected to the leeward upper and lower header sections 5 and 8 in a state in which the upper and lower end portions project into the interiors of the leeward upper and lower header sections 5 and 8. Upper and lower end portions of the heat exchange tubes 14 of the windward tube row 16 are communicatably connected to the windward upper and lower header sections 6 and 9 in a state in which the upper and lower end portions project into the interiors of the windward upper and lower header sections 6 and 9.

The upper header tank 2 includes a first tank constituting member 20, a second tank constituting member 21, a third tank constituting member 22, and an end member 25, which are formed of aluminum. The first tank constituting member 20 forms lower portions of the leeward upper header section 5 and the windward upper header section 6, and the heat exchange tubes 14 of the two tube rows 15 and 16 are connected to the first tank constituting member 20. The second tank constituting member 21 is brazed to the first tank constituting member 20, covers the side (upper side) of the first tank constituting member 20 opposite the heat exchange tubes 14, and forms upper portions of the leeward upper header section 5 and the windward upper header section 6. The third tank constituting member 22 is disposed between the first tank constituting member 20 and the second tank constituting member 21 and has front and rear partition portions 23 and 24 for dividing the interiors of the leeward upper header section 5 and the windward upper header section 6 into upper spaces 5*a* and 6*a* and lower spaces 5*b* and 6*b*. The end member 25 has the refrigerant inlet 12 and the refrigerant outlet 13, and is brazed to the right ends of the first through third tank constituting members 20, 21, and 22.

The first tank constituting member 20 is formed by performing press work on an aluminum brazing sheet having a brazing material layer on each of opposite sides thereof. The first tank constituting member 20 includes a first header forming portion 26 which has a generally U-like shape as viewed on a transverse cross section thereof and which forms a lower portion (a portion on the side toward the heat exchange tubes 14) of the leeward upper header section 5; a second header forming portion 27 which has a generally U-like shape as viewed on a transverse cross section thereof and which forms a lower portion (a portion on the side toward the heat exchange tubes 14) of the windward upper header section 6; and a connection wall 28 which connects the two header forming portions 26 and 27 together and which forms a lower portion of the connection portion 7. Tube insertion holes 29 elongated in the front-rear direction are formed in the header forming portions 26 and 27 of the first tank constituting member 20 such that they are spaced from one another in the left-right direction and the tube insertion holes 29 of the header forming portion 26 are located at the same positions (in the left-right direction) as those of the corresponding tube insertion holes 29 of the header forming portion 27. Upper end portions of the heat exchange tubes 14 are inserted into the tube insertion holes 29 and are brazed to the first tank constituting member 20 by making use of the brazing material layer of the first tank constituting member 20.

The second tank constituting member 21 is formed by performing press work on an aluminum brazing sheet having a brazing material layer on each of opposite sides thereof. The second tank constituting member 21 includes a first header forming portion 31 which has a generally inverted U-like shape as viewed on a transverse cross section thereof and which forms an upper portion (a portion on the side opposite the heat exchange tubes 14) of the leeward upper header section 5; a second header forming portion 32 which has a generally inverted U-like shape as viewed on a transverse cross section thereof and which forms an upper portion (a portion on the side opposite the heat exchange tubes 14) of the windward upper header section 6; and a connection wall 33 which connects the two header forming portions 31 and 32 together and which forms an upper portion of the connection portion 7. Although not illustrated in detail, communication openings 34 for establishing communication between the upper space 5*a* of the leeward header section 5 and the upper space 6*a* of the windward upper header section 6 are formed in the second tank constituting member 21 at proper positions in the left-right direction by deforming the first header forming portion 31, the second header forming portion 32 and the connection wall 33.

The third tank constituting member 22 is formed by performing press work on an aluminum brazing sheet having a brazing material layer on each of opposite sides thereof. The front and rear partition portions 23 and 24 of the third tank constituting member 22 are connected and united together by a connection wall 35 which is disposed between the connection wall 28 of the first tank constituting member 20 and the connection wall 33 of the second tank constituting member 21 and is brazed to the two connection walls 28 and 33. The connection wall 35 forms an intermediate portion (with respect to the vertical direction) of the connection portion 7. The two partition portions 23 and 24 and the connection wall 35 are located on the same plane. Communication holes 23*a* for establishing communication between the upper and lower spaces 5*a* and 5*b* of the leeward upper header section 5 are formed in the front partition portion 23 of the third tank constituting member 22 at proper positions, and communication holes 24*a* for establishing communication between the upper and lower spaces 6*a* and 6*b* of the windward upper header section 6 are formed in the rear partition portion 24 of the third tank constituting member 22 at proper positions.

Slits 36 elongated in the front-rear direction are formed in left end portions of the front and rear partition portions 23 and 24 of the third tank constituting member 22 (end portions of the leeward and windward header sections 5 and 6 of the upper header tank 2 which has the refrigerant inlet 12 and the refrigerant outlet 13 at its one end opposite the end portions). A closing plate 37 for closing the left ends of the upper and lower spaces 5*a* and 5*b* of the leeward upper header section 5 is inserted into the slit 36 of the front partition portion 23 and is brazed to the first through third tank constituting members 20, 21, and 22. Another closing plate 37 for closing the left ends of the upper and lower spaces 6*a* and 6*b* of the windward upper header section 6 is inserted into the slit 36 of the rear partition portion 24 and is brazed to the first through third tank constituting members 20, 21, and 22. The closing plates 37 are formed from an aluminum brazing sheet having a brazing material layer on each of opposite sides thereof. The front partition portion 23 has a cutout 38 extending from the right end thereof. The cutout 38 establishes communication between the upper and lower spaces 5*a* and 5*b*, and the refrigerant inlet 12 communicates with the two spaces 5*a* and 5*b*. The rear partition portion 24 has a cutout 39 extending from the right end thereof. The cutout 39 establishes communication between the upper and lower spaces 6*a* and 6*b*, and the refrigerant outlet 13 communicates with the two spaces 6*a* and 6*b*.

Figure 5:
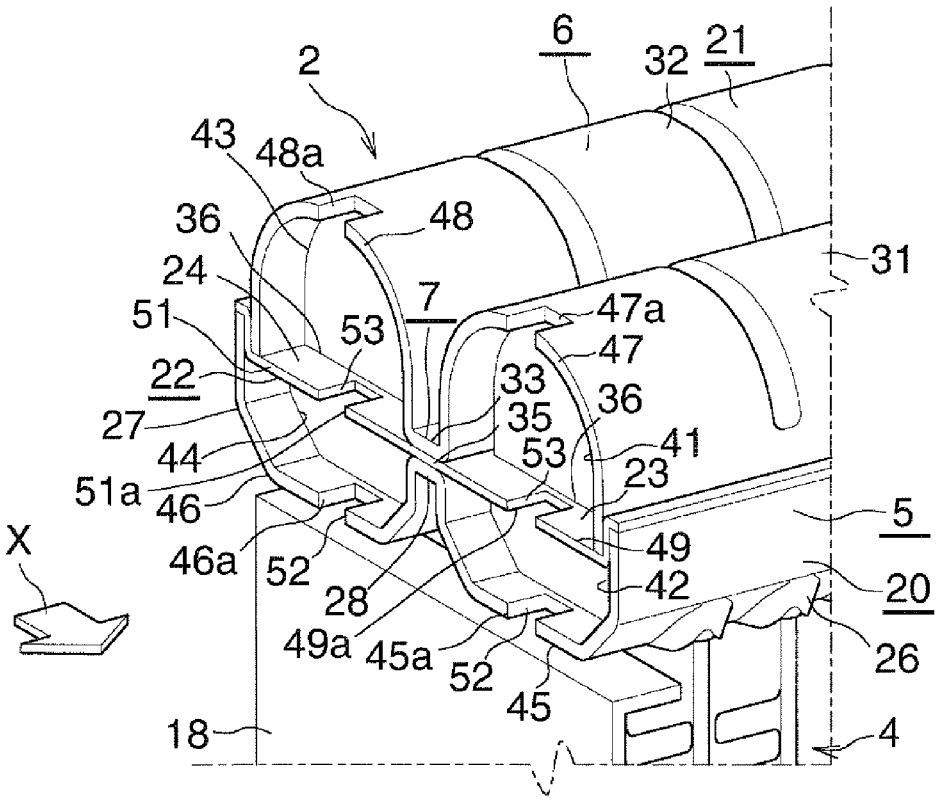
FIG. 5 is a partially omitted perspective view showing a left side portion of the evaporator of FIG. 1.
Figure 5:
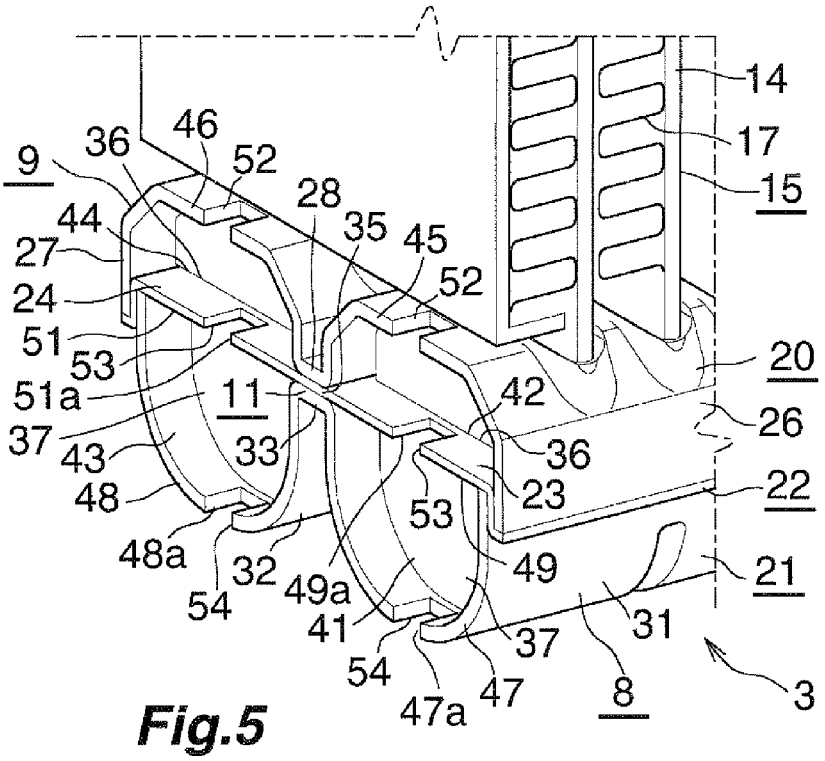

As shown in FIG. 5, recess 41, 42, 43, and 44 are formed on the outer surface of the left end of the upper header tank 2 at locations corresponding to the upper and lower spaces 5*a* and 5*b* of the leeward upper header section 5 and the upper and lower spaces 6*a* and 6*b* of the windward upper header section 6. The recess 41, 42, 43, and 44 are formed by projecting portions 45, 46, 47, 48, 49, and 51 of the first through third tank constituting member 20, 21, and 22 which project outward or leftward beyond the closing plate 37 and which surround the recess 41, 42, 43, and 44. Namely, the front and rear lower recesses 42 and 44 are surrounded by the projecting portions 45 and 46 of the two header forming portions 26 and 27 of the first tank constituting member 20 and the projecting portions 49 and 51 of the front and rear partition portions 23 and 24 of the third tank constituting member 22. Similarly, the front and rear upper recesses 41 and 43 are surrounded by the projecting portions 47 and 48 of the two header forming portions 31 and 32 of the second tank constituting member 21 and the projecting portions 49 and 51 of the front and rear partition portions 23 and 24 of the third tank constituting member 22.

Drain openings 52 are formed in the projecting portions 45 and 46 of the two header forming portions 26 and 27 of the first tank constituting member 20 at their central positions with respect to the front-rear direction. The drain openings 52 are formed by cutouts 45*a* and 46*a* extending from the left ends of the projecting portions 45 and 46, and drain water downward from the front and rear lower recesses 42 and 44. Drain openings 53 are formed in the projecting portions 49 and 51 of the two header forming portions 23 and 24 of the third tank constituting member 22 at their central positions with respect to the front-rear direction. The drain openings 53 are formed by cutouts 49*a* and 51*a* extending from the left ends of the projecting portions 49 and 51, and drain water downward from the front and rear upper recesses 41 and 43. Cutouts 47*a* and 48*b* are formed in the projecting portions 47 and 48 of the two header forming portions 31 and 32 of the second tank constituting member 21 at their central positions with respect to the front-rear direction such that the cutouts 47*a* and 48*b* extend from the left ends of the projecting portions 47 and 48.

The lower header tank 3 and the upper header tank 2 are substantially identical in structure and are disposed in a mirror-image relation. Therefore, portions of the lower header tank 3 identical with those of the upper header tank 2 are denoted by the same reference numerals. Notably, the refrigerant inlet 12 and the refrigerant outlet 13 are not provided on the lower header tank 3, and therefore, the end portion 25 is also not provided on the lower header tank 3. The first tank constituting member 20 forms the upper portions of the leeward lower header section 8 and the windward lower header section 9. The second tank constituting member 21 covers the side (lower side) of the first tank constituting member 20 opposite the heat exchange tubes 14, and forms the lower portions of the leeward lower header section 8 and the windward lower header section 9. The front partition portion 23 of the third tank constituting member 22 divides the interior of the leeward lower header section 8 into upper and lower spaces 8*b* and 8*a*, and the rear partition portion 24 of the third tank constituting member 22 divides the interior of the windward lower header section 9 into upper and lower spaces 9*b* and 9*a*. The lower spaces 8*a* and 9*a* of the leeward lower header section 8 and the windward lower header section 9 have configurations similar to those of the upper spaces 5*a* and 6*a* of the leeward upper header section 5 and the windward upper header section 6. The upper spaces 8*b* and 9*b* of the leeward lower header section 8 and the windward lower header section 9 have configurations similar to those of the lower spaces 5*b* and 6*b* of the leeward upper header section 5 and the windward upper header section 6. Notably, the first and second tank constituting members 20 and 21 of the lower header tank 3 have configurations similar to those of the first and second tank constituting members 20 and 21 of the upper header tank 2.

Slits 36 elongated in the front-rear direction are formed in left and right end portions of the front and rear partition portions 23 and 24 of the third tank constituting member 22. Closing plates 37 for closing the left and right ends of the upper and lower spaces 8*b* and 8*a* of the leeward lower header section 8 are inserted into the slits 36 of the front partition portion 23 and are brazed to the first through third tank constituting members 20, 21, and 22. Closing plates 37 for closing the left and right ends of the upper and lower spaces 9*b* and 9*a* of the windward lower header section 9 are inserted into the slits 36 of the rear partition portion 24 and are brazed to the first through third tank constituting members 20, 21, and 22. Therefore, the opposite ends of the leeward and windward header sections 8 and 9 of the other header tank 3 which does not have the refrigerant inlet 12 and the refrigerant outlet 13 are closed by the closing plates 37 inserted into the slits 36 formed in the partition portions 23 and 24 of the third tank constituting member 22.

Like the recess 41, 42, 43, and 44 at the left end of the upper header tank 2, recess 41, 42, 43, and 44 are formed on the outer surfaces of the left and right ends of the lower header tank 3 at locations corresponding to the upper and lower spaces 8*b* and 8*a* of the leeward lower header section 8 and the upper and lower spaces 9*b* and 9*a* of the windward lower header section 9. Namely, the front and rear upper recesses 42 and 44 are surrounded by the projecting portions 45 and 46 of the two header forming portions 26 and 27 of the first tank constituting member 20 and the projecting portions 49 and 51 of the front and rear partition portions 23 and 24 of the third tank constituting member 22. Similarly, the front and rear lower recesses 41 and 43 are surrounded by the projecting portions 47 and 48 of the two header forming portions 31 and 32 of the second tank constituting member 21 and the projecting portions 49 and 51 of the front and rear partition portions 23 and 24 of the third tank constituting member 22.

Drain openings 53 are formed in the projecting portions 49 and 51 of the front and rear partition portions 23 and 24 of the third tank constituting member 22 at their central positions with respect to the front-rear direction. The drain openings 53 are formed by cutouts 49*a* and 51*a*, and drain water downward from the front and rear upper recesses 42 and 44. Drain openings 54 are formed in the projecting portions 47 and 48 of the two header forming portions 31 and 32 of the second tank constituting member 21 at their central positions with respect to the front-rear direction. The drain openings 54 are formed by cutouts 47*a* and 48*a*, and drain water downward from the front and rear lower recesses 41 and 43. Furthermore, drain openings 52 are formed in the projecting portions 45 and 46 of the two header forming portions 26 and 27 of the first tank constituting member 20 at their central positions with respect to the front-rear direction. The drain openings 52 are formed by cutouts 45*a* and 46*a*, and drain water downward from the upper surface of the lower header tank 3.

The above-described evaporator 1 constitutes a refrigeration cycle in cooperation with a compressor, a condenser (refrigerant cooler), and an expansion valve (pressure reducer); and the refrigeration cycle is mounted on a vehicle (e.g., an automobile) as a car air conditioner. When the car air conditioner is operated, refrigerant having passed through the compressor, the condenser, and the expansion valve flows into the evaporator 1 through the refrigerant inlet 12, and flows out of the refrigerant outlet 13. While flowing through the heat exchange tubes 13 of the front row and the heat exchange tubes 13 of the rear row, the refrigerant exchanges heat with air flowing through the air-passing clearances of the heat exchange core section 4, whereby the air is cooled. The refrigerant then flows out in vapor phase.

At that time, condensed water accumulates within the recesses 41, 42, 43, and 44. However, this condensed water is drained to the outside of the recesses 41, 42, 43, and 44 through the drain openings 52, 53, and 54. Accordingly, it is possible to prevent propagation of miscellaneous germs or the like which propagate within the condensed water accumulating within the recesses 41, 42, 43, and 44 and which produce an offensive odor.

Figure 6:
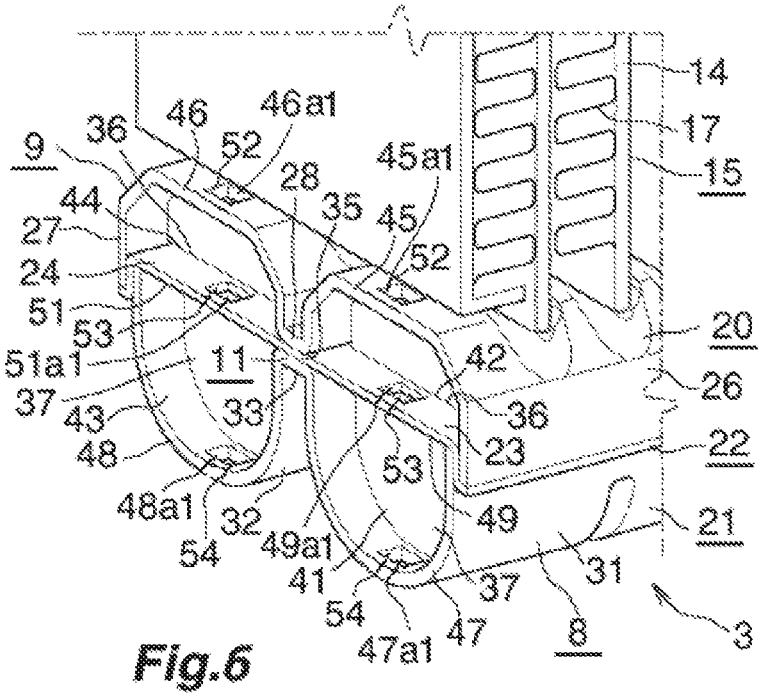
FIG. 6 is a partially omitted perspective view showing a bottom, left side portion of the evaporator of FIG. 1 with an alternative embodiment of drain openings formed as through-holes.

In the above-described embodiment, the drain openings 52, 53, and 54 of the wall portions surrounding the recesses 41, 42, 43, and 44 are the cutouts 45*a*, 46*a*, 47*a*, 48*a*, 49*a*, and 51*a* formed in the projecting portions 45, 46, 47, 48, 49, and 51. However, the drain openings 52, 53, and 54 may be through-holes formed in the projecting portions 45, 46, 47, 48, 49, and 51, as shown by through-holes 45*a*1, 46*a*1, 47*a*1, 48*a*1, 49*a*1, and 51*a*1 formed in the projecting portions 45, 46, 47, 48, 49, and 51 of the two header forming portions 31 and 32 of the second tank constituting member 21 in FIG. 6.

According to the embodiment of the present invention, a drain opening for draining water from the recess is formed in a lower portion of a wall portion of the header tank surrounding the recess. Thus, condensed water produced during operation of a car air conditioner is prevented from accumulating within the recess. Accordingly, it is possible to prevent propagation of miscellaneous germs or the like which propagate within the condensed water accumulating within the recess and which produce an offensive odor.

Obviously, numerous modifications and variations of the present invention are possible in light of the above teachings. It is therefore to be understood that within the scope of the appended claims, the invention may be practiced otherwise than as specifically described herein.

What is claimed is:

1. An evaporator comprising:

an upper header tank having a first longitudinal direction and comprising:

a first upper header section extending in the first longitudinal direction and having a first end and a second end opposite to the first end in the first longitudinal direction; and a second upper header section extending in the first longitudinal direction and having a third end and a fourth end opposite to the third end in the first longitudinal direction;

a lower header tank having a second longitudinal direction which is substantially parallel to the first longitudinal direction and comprising:

a first lower header section extending in the second longitudinal direction and having a fifth end and a sixth end opposite to the fifth end in the second longitudinal direction; and a second lower header section extending in the second longitudinal direction and having a seventh end and a eighth end opposite to the seventh end in the second longitudinal direction;

an inlet end among the first to eighth ends including an inlet connection portion to be connected to an inlet pipe through which refrigerant is to flow into the evaporator;

an outlet end among the first to eighth ends including an outlet connection portion to be connected to an outlet pipe through which refrigerant is to flow out from the evaporator;

other ends other than the inlet end and the outlet end being closed by end walls, respectively, a recess wall being provided on a side of an outer surface of at least one of the end walls to define a recess on the outer surface, a partition portion extending across the recess on the side of the outer surface of the at least one of the end walls such that the partition portion divides the recess into an upper portion and a lower portion;

a drain opening provided in the partition portion to drain water from the upper portion to the lower portion when the evaporator is oriented in an operational state;

a drain opening provided at a lowermost portion of the recess wall to drain water from the recess, the drain opening at the lowermost portion of the recess wall being formed below the drain opening in the partition portion, the drain opening in the partition portion and the drain opening at the lowermost portion of the recess wall being aligned along a line; and heat exchange tubes having upper end portions and lower end portions, respectively, the upper end portions being connected to the upper header tank, the lower end portions being connected to the lower header tank.

2. The evaporator according to claim 1, wherein each header tank has a first tank constituting member to which the heat exchange tubes are connected; a second tank constituting member which is joined to the first tank constituting member and which covers a side of the first tank constituting member opposite the heat exchange tubes; and a third tank constituting member disposed between the first tank constituting member and the second tank constituting member, wherein end portions of the first, second, and third tank constituting members serve as a surrounding wall portion of the header tank which surrounds the recess.

3. The evaporator according to claim 2, wherein each of the header tanks has a leeward header section located on a leeward side and a windward header section located on a windward side; at least one row of the heat exchange tubes are disposed between the leeward header sections of the two header tanks, and opposite end portions of the heat exchange tubes are connected to the leeward header sections of the two header tanks; at least one row of the heat exchange tubes are disposed between the windward header sections of the two header tanks, and opposite end portions of the heat exchange tubes are connected to the windward header sections of the two header tanks; a refrigerant inlet is provided at one end of the leeward header section of one header tank; a refrigerant outlet is provided at one end of the windward header section of the one header tank, which one end is located on the same side as the one end of the leeward header section; the third tank constituting member of each header tank has partition portions which vertically divide the interiors of the leeward and windward header sections of the header tank into upper and lower spaces; the leeward and windward header sections of the one header tank having the refrigerant inlet and the refrigerant outlet at one end thereof are closed, at their ends located on the side opposite the one end of the one header tank, by closing plates which are inserted into slits formed in the partition portions of the third tank constituting member of the one header tank; opposite ends of the leeward and windward header sections of the other header tank are closed by closing plates which are inserted into slits formed in the partition portions of the third tank constituting member of the other header tank; and the first, second, and third tank constituting members have projecting portions which project outward beyond the corresponding closing plates and serve as surrounding wall portions which surround the corresponding recesses of the header tanks.

4. An evaporator according to claim 3, wherein the first tank constituting member has two header forming portions each of which has a U-shaped transverse cross section, which form portions of the leeward and windward header sections on the side toward the heat exchange tubes, and which has projecting portions projecting outward beyond the closing plates; the second tank constituting member has two header forming portions each of which has a U-shaped transverse cross section, which form portions of the leeward and windward header sections on the side opposite the heat exchange tubes, and which has projecting portions projecting outward beyond the closing plates; the two partition portions of the third tank constituting member have projecting portions projecting outward beyond the closing plates; drain openings are formed in the projecting portions of the two header forming portions of the first tank constituting member of the upper header tank, and drain openings are formed in the projecting portions of the two partition portions of the third tank constituting member of the upper header tank; and drain openings are formed in the projecting portions of the two header forming portions of the second tank constituting member of the lower header tank, and drain openings are formed in the projecting portions of the two partition portions of the third tank constituting member of the lower header tank.

5. The evaporator according to claim 1, wherein the drain opening at the lowermost portion of the recess wall is a cutout formed in a surrounding wall portion that extends about the recess.

6. The evaporator according to claim 1, wherein the drain opening at the lowermost portion of the recess wall is a through-hole formed in a surrounding wall portion that extends about the recess.

7. The evaporator according to claim 1, wherein the recess is formed by a projecting portion that projects in the longitudinal direction beyond the end wall of the at least one header section, and wherein the drain opening at the lowermost portion of the recess wall is formed in a lowermost surface of the projecting portion.

8. The evaporator according to claim 1, further comprising an additional drain opening formed in an uppermost portion of the wall portion at another location within the recess.

9. The evaporator according to claim 1, wherein the drain opening at the lowermost portion of the recess wall is a cutout notch formed at a terminal end of the wall portion in the longitudinal direction.

10. The evaporator according to claim 1, wherein the line is substantially parallel to a vertical direction when the evaporator is oriented in the operational state.

* * * * *